US010867746B2

(12) United States Patent
Yen et al.

(10) Patent No.: US 10,867,746 B2
(45) Date of Patent: Dec. 15, 2020

(54) INDUCTOR STRUCTURE

(71) Applicant: Realtek Semiconductor Corporation, Hsinchu (TW)

(72) Inventors: Hsiao-Tsung Yen, Hsinchu (TW); Chih-Yu Tsai, Hsinchu (TW); Kai-Yi Huang, Taipei (TW)

(73) Assignee: REALTEK SEMICONDUCTOR CORPORATION, Hsinchu (TW)

( * ) Notice: Subject to any disclaimer, the term of this patent is extended or adjusted under 35 U.S.C. 154(b) by 716 days.

(21) Appl. No.: 15/199,956

(22) Filed: Jun. 30, 2016

(65) Prior Publication Data

US 2017/0169939 A1 Jun. 15, 2017

(30) Foreign Application Priority Data

Dec. 15, 2015 (TW) ..... 104142119 A

(51) Int. Cl.

| | |
|---|---|
| ***H01F 27/40*** | (2006.01) |
| ***H01F 17/00*** | (2006.01) |
| ***H01F 27/28*** | (2006.01) |
| ***H01F 27/29*** | (2006.01) |
| *H01F 21/12* | (2006.01) |

(52) U.S. Cl.

CPC ..... *H01F 27/40* (2013.01); *H01F 17/0006* (2013.01); *H01F 27/2804* (2013.01); *H01F 27/29* (2013.01); *H01F 17/0013* (2013.01); *H01F 21/12* (2013.01); *H01F 2017/0073* (2013.01); *H01F 2027/2814* (2013.01)

(58) Field of Classification Search

CPC ..... H01F 27/40; H01F 2017/0073

See application file for complete search history.

(56) References Cited

U.S. PATENT DOCUMENTS 6,661,325 B2 12/2003 Suh et al.
6,775,901 B1 * 8/2004 Lee ..... H01F 17/0033 29/602.1
7,023,315 B2 4/2006 Yeo et al.
7,501,709 B1 * 3/2009 Hool ..... H01L 23/64 257/691

(Continued)

FOREIGN PATENT DOCUMENTS

CN 101494112 A 7/2009
CN 101752066 A 6/2010

(Continued)

OTHER PUBLICATIONS

The office action of the corresponding Chinese application dated Jan. 10, 2018 and its English summary.

*Primary Examiner* — Elvin G Enad
*Assistant Examiner* — Malcolm Barnes
(74) *Attorney, Agent, or Firm* — CKC & Partners Co., LLC

(57) ABSTRACT

An inductor structure includes a first curve metal component, a second curve metal component, and a connection component. The first curve metal component is disposed on a layer. The layer is located at a first plane, the first curve metal component is located at a second plane, and the first plane is perpendicular to the second plane. The second curve metal component is disposed on the layer. The second curve metal component is located at the second plane. The connection component is coupled to the first curve metal component and the second curve metal component.

12 Claims, 10 Drawing Sheets

(56) References Cited

U.S. PATENT DOCUMENTS

| | | | | |
|---|---|---|---|---|
| 8,183,971 | B2 | 5/2012 | Le Guillou et al. | |
| 2005/0017352 | A1* | 1/2005 | Lee | H01L 24/06 257/728 |
| 2005/0167828 | A1* | 8/2005 | Yeo | H01L 23/645 257/734 |
| 2007/0128821 | A1* | 6/2007 | Lee | H01F 19/04 438/381 |
| 2009/0188104 | A1 | 7/2009 | Ching et al. | |
| 2009/0195325 | A1* | 8/2009 | Menon | H01L 23/66 333/32 |
| 2009/0236701 | A1* | 9/2009 | Sun | G06F 17/5036 257/665 |
| 2011/0316657 | A1* | 12/2011 | Park | H01F 17/0006 336/200 |
| 2012/0082194 | A1* | 4/2012 | Tam | H04B 5/0031 375/219 |
| 2012/0105304 | A1* | 5/2012 | Ma | H01L 23/66 343/906 |
| 2012/0249282 | A1 | 10/2012 | Sin et al. | |
| 2013/0099974 | A1* | 4/2013 | Wang | H01Q 1/007 342/372 |
| 2014/0197918 | A1* | 7/2014 | Kang | H05K 1/165 336/200 |
| 2014/0253391 | A1* | 9/2014 | Yen | H01Q 1/36 343/700 MS |
| 2016/0064140 | A1* | 3/2016 | Cuoco | H01F 5/00 330/124 R |

FOREIGN PATENT DOCUMENTS

| | | | |
|---|---|---|---|
| CN | 102738128 | A | 10/2012 |
| TW | 200701272 | A | 1/2007 |
| TW | 201230086 | A | 7/2012 |
| TW | 201237895 | A | 9/2012 |

* cited by examiner

INDUCTOR STRUCTURE

RELATED APPLICATIONS

This application claims priority to Taiwan Application Serial Number 104142119, filed Dec. 15, 2015, which is herein incorporated by reference.

BACKGROUND

Field of Invention

The present disclosure relates to a basic electronic circuit. More particularly, the present disclosure relates to an inductor structure.

Description of Related Art

In an advanced manufacturing process, designs of spiral-shaped inductors or 8-shaped inductors are limited by the area of the chip, and moreover, the cost of spiral-shaped inductors and 8-shaped inductors is high. In addition, such inductors are close to a substrate such that coupling easily occurs between the inductors and the substrate, thereby significantly affecting the quality factor of the inductors.

In view of the foregoing, problems and disadvantages are associated with existing products that require further improvement. However, those skilled in the art have yet to find a solution.

SUMMARY

In order to solve the problems mentioned above, one aspect of the present disclosure is directed to an inductor structure. The inductor structure comprises a first curve metal component, a second curve metal component, and a connection component. The first curve metal component is disposed on a layer. The layer is located at a first plane, the first curve metal component is located at a second plane, and the first plane is perpendicular to the second plane. The second curve metal component is disposed on the layer. The second curve metal component is located at the second plane. The connection component is coupled to the first curve metal component and the second curve metal component.

In view of the foregoing, embodiments of the present disclosure provide an inductor structure to improve the problems related to designs of spiral-shaped inductors or 8-shaped inductors being limited by the area of the chip, and related also to the cost of spiral-shaped inductors and 8-shaped inductors being high. Furthermore, embodiments of the present disclosure provide an inductor structure to improve the problems related to the inductors being close to a substrate such that coupling easily occurs between the inductors and the substrate to thereby significantly affect the quality factor of the inductors.

BRIEF DESCRIPTION OF THE DRAWINGS

The disclosure can be more fully understood by reading the following detailed description of the embodiment, with reference made to the accompanying drawings as follows.

DETAILED DESCRIPTION

Unless otherwise defined herein, scientific and technical terminologies employed in the present disclosure shall have the meanings that are commonly understood and used by one of ordinary skill in the art. Unless otherwise required by context, it should be understood that singular terms shall include plural forms of the same and plural terms shall include singular forms of the same.

In the following description, the terms "coupled" may be used to indicate that two or more elements are in direct physical or electrical contact with each other, or may also mean that two or more elements may be in indirect physical or electrical contact with each other. "Coupled" may still be used to indicate that two or more elements cooperate or interact with each other.

Figure 1:
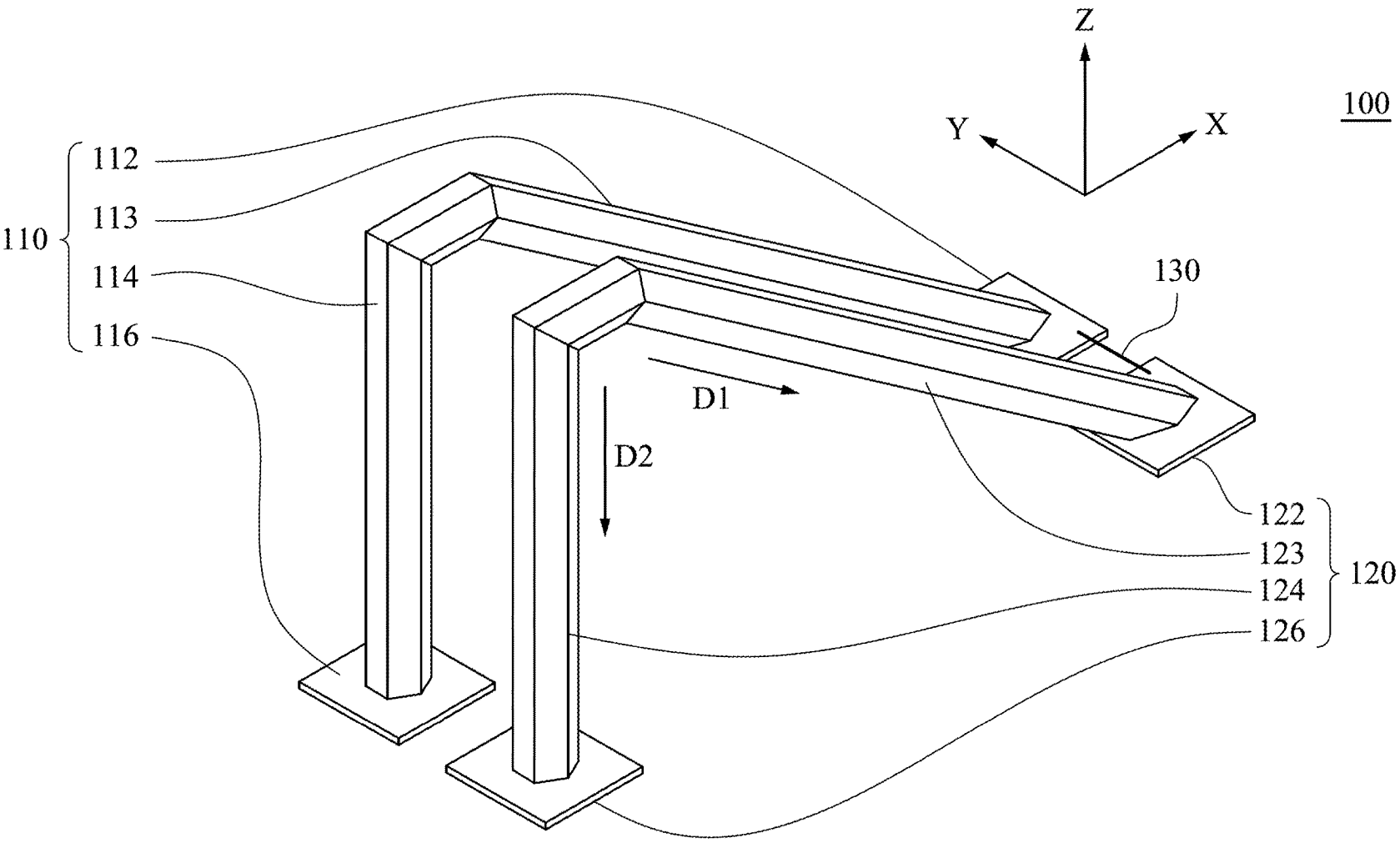
FIG. 1 is a schematic diagram of an inductor structure according to embodiments of the present disclosure.

FIG. 1 is a schematic diagram of an inductor structure according to embodiments of the present disclosure. The inductor structure 100 comprises a first curve metal component 110, a second curve metal component 120 and a connection component 130. The first curve metal component 110 is disposed on a layer (not shown in the figure). The layer is located at a first plane (e.g., an XY plane), and the layer can be a CMOS oxide layer or another similar structure. The first curve metal component 110 is located at a second plane (e.g., an XZ plane), and the first plane is perpendicular to the second plane. The second curve metal component 120 is disposed on the layer, and the second curve metal component 120 is located at the second plane. The connection component 130 is coupled to the first curve metal component 110 and the second curve metal component 120. Therefore, the connection component 130 is used to couple the curved metal components 110, 120, such that the curved metal components 110, 120 and the connection component 130 form an inductor structure. The inductor structure 100 restructures a ring-shaped inductor which is laid on the first plane (e.g., the XY plane), and then separated into the curved metal components 110, 120. The ring-shaped inductor comprising the curved metal components 110, 120 is raised from the first plane (e.g., the XY plane) to the second plane (e.g., the XZ plane). Hence, compared with spiral-shaped inductors or 8-shaped inductors, the inductor structure 100 of the present disclosure occupies a smaller area, and the quality factor (e.g., Q value) of the inductor structure 100 of the present disclosure is also higher.

In one embodiment, the first curve metal component 110 and the second curve metal component 120 comprise first strip portions 113, 123 and second strip portions 114, 124 which are coupled to each other. The first strip portions 113, 123 and the second strip portions 114, 124 are disposed in a first direction and a second direction respectively. For example, the first strip portions 113, 123 are disposed in the first direction D1, and the second strip portions 114, 124 are disposed in the second direction D2. As shown in the figure, the first direction D1 is different from the second direction D2. For example, the angle between the first direction D1 and the XY plane is about 45 degrees, and the second direction D2 is roughly perpendicular to the XY plane. In addition, the first strip portions 113, 123 are located at one side of the inductor structure 100, and the second strip portions 114, 124 are located at another side of the inductor structure 100. In one embodiment, the connection component 130 is coupled to the first strip portion 113 of the first curve metal component 110 and the first strip portion 123 of the second curve metal component 120.

Figure 2:
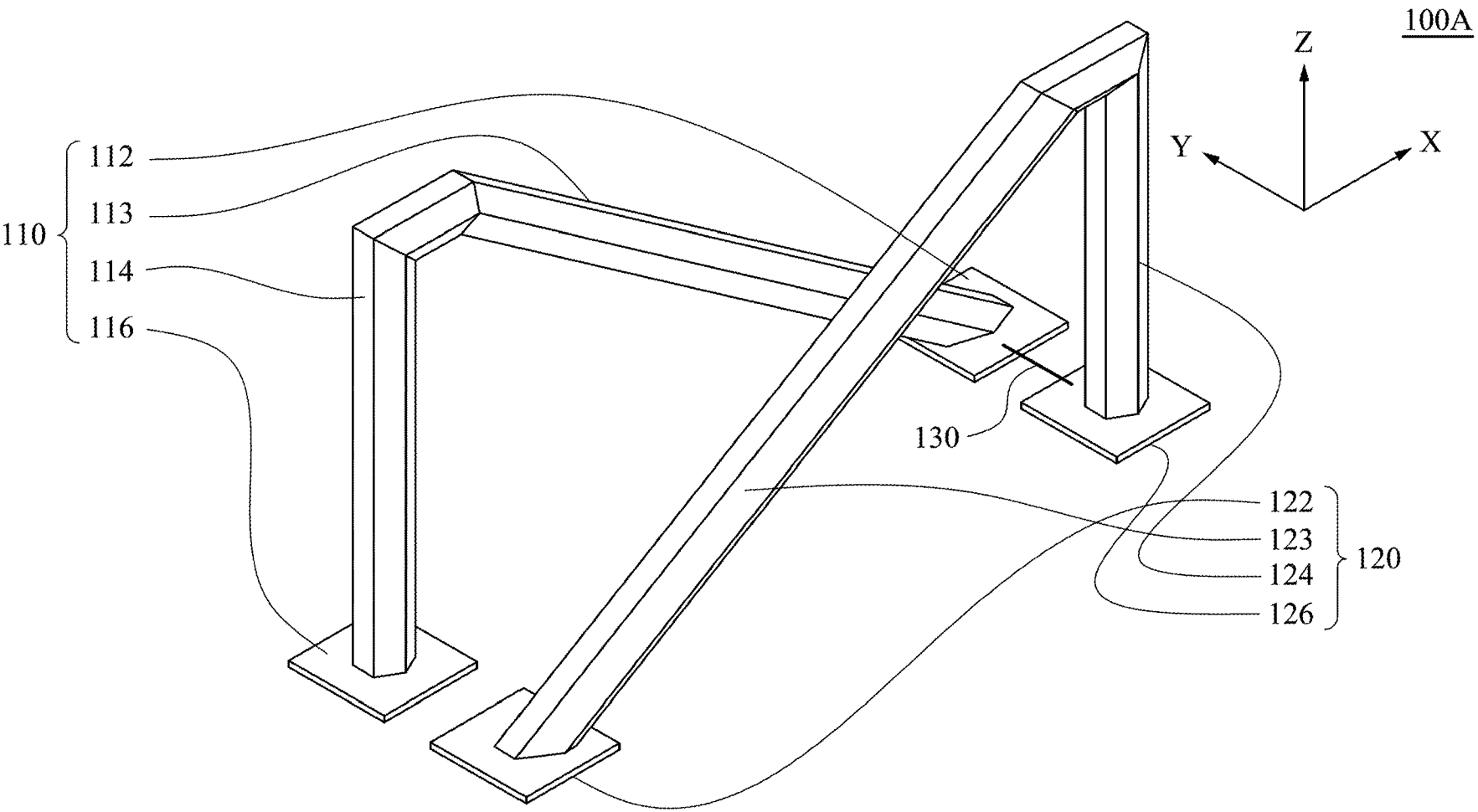
FIG. 2 is a schematic diagram of an inductor structure according to embodiments of the present disclosure.

FIG. 2 is a schematic diagram of an inductor structure according to embodiments of the present disclosure. Compared with the inductor structure 100 of FIG. 1, the disposition of the first curve metal component 110 and the second curve metal component 120 of the inductor structure 100A of FIG. 2 is different, which is described below. The first strip portion 113 of the first curve metal component 110 and the second strip portion 124 of the second curve metal component 120 are located at one side of the inductor structure 100A, and the second strip portion 114 of the first curve metal component 110 and the first strip portion 123 of the second curve metal component 120 are located at another side of the inductor structure 100A. In one embodiment, the connection component 130 is coupled to the first strip portion 113 of the first curve metal component 110 and the second strip portion 124 of the second curve metal component 120. It is noted that the basic structures of the curved metal components 110, 120 of FIG. 2 are similar to those of the curved metal components 110, 120 of FIG. 1, such that a detailed description of the basic structures in FIG. 2 is omitted herein.

Figure 3:
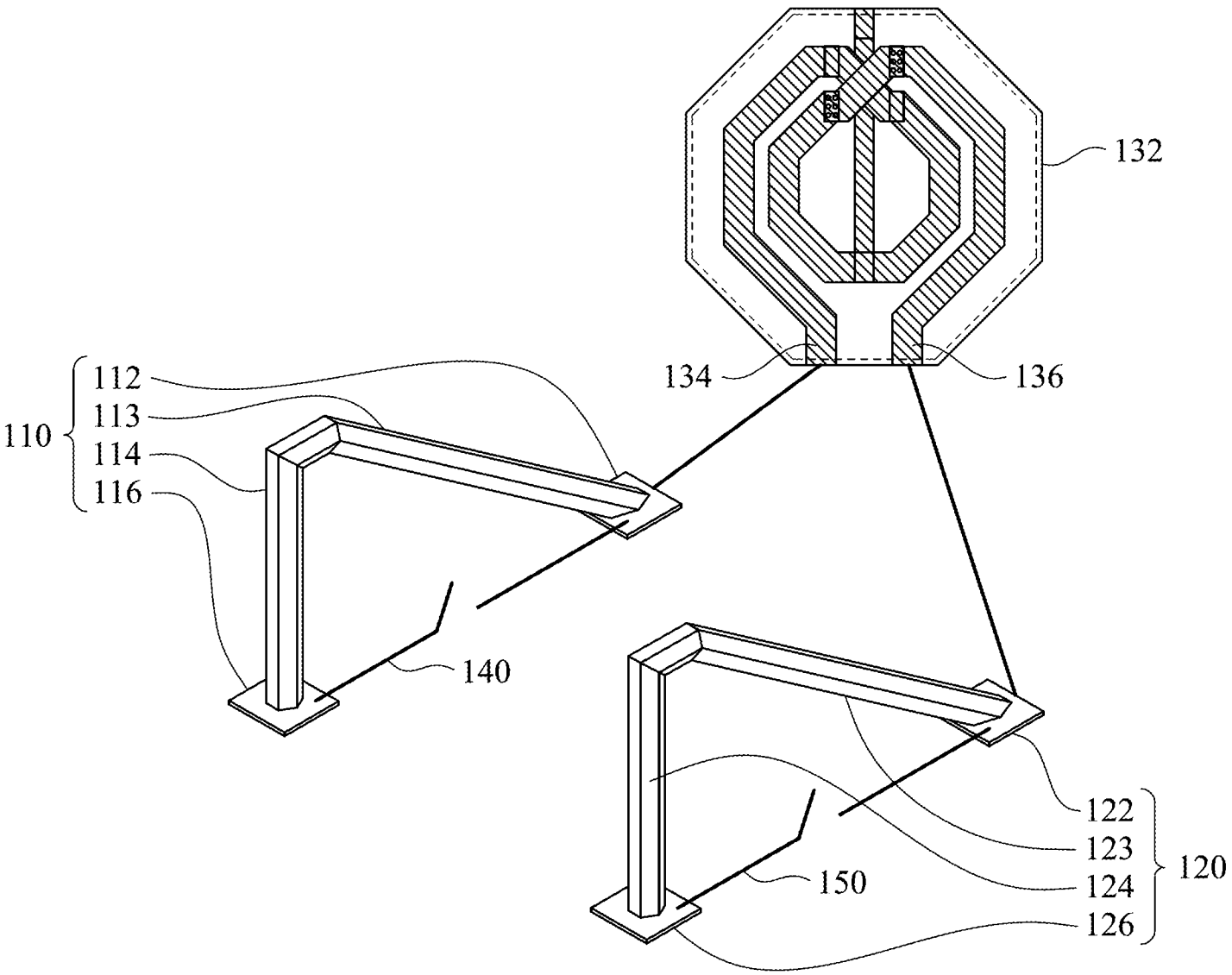
FIG. 3 is a schematic diagram of an inductor structure according to embodiments of the present disclosure.

FIG. 3 is a schematic diagram of an inductor structure according to embodiments of the present disclosure. Compared with the inductor structure 100 of FIG. 1, the connection component 130 of the inductor structure 100B in FIG. 3 comprises a spiral-shaped inductor 132. A first terminal 112 of the first curve metal component 110 is coupled to a first terminal 134 of the spiral-shaped inductor 132, and a first terminal 122 of the second curve metal component 120 is coupled to a second terminal 136 of the spiral-shaped inductor 132. In one embodiment, the inductor structure 100B further comprises a first switch 140 and a second switch 150. The first switch 140 is coupled between the first terminal 112 and a second terminal 116 of the first curve metal component 110, and the second switch 150 is coupled between the first terminal 122 and a second terminal 126 of the second curve metal component 120. Since the inductor structure 100B further comprises the switches 140, 150, the inductance of the inductor structure 100B can be adjusted by controlling the switches 140, 150, such that the application range of the inductor structure 100B can be extended. It is noted that the basic structures of the curved metal components 110, 120 of FIG. 3 are similar to those of the curved metal components 110, 120 of FIG. 1, such that a detailed description of the basic structures in FIG. 3 is omitted herein.

Figure 4:
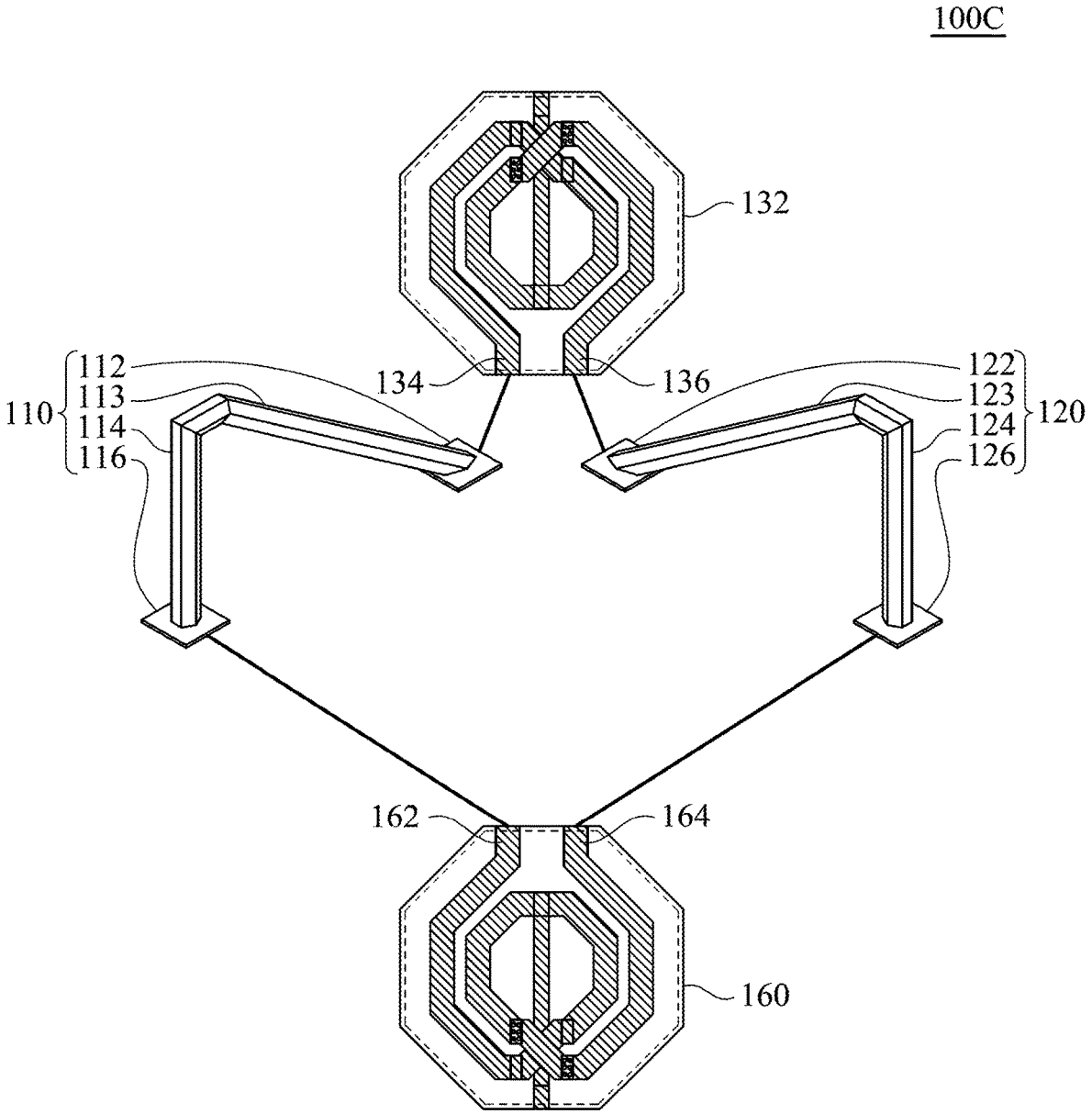
FIG. 4 is a schematic diagram of an inductor structure according to embodiments of the present disclosure.

FIG. 4 is a schematic diagram of an inductor structure according to embodiments of the present disclosure. Compared with the inductor structure 100B of FIG. 3, the inductor structure 100C of FIG. 4 further comprises a spiral-shaped inductor 160. The second terminal 116 of the first curve metal component 110 is coupled to a first terminal 162 of the spiral-shaped inductor 160, and the second terminal 126 of the second curve metal component 120 is coupled to a second terminal 164 of the spiral-shaped inductor 160. It is noted that except for the above-mentioned features, the basic structures of the inductor structure 100C of FIG. 4 are similar to those of the inductor structure 100B of FIG. 3, such that a detailed description of the basic structures in FIG. 4 is omitted herein. Moreover, the switches 140, 150 of the inductor structure 100C can be selectively disposed between two terminals of the first curve metal component 110 and/or disposed between two terminals of the second curve metal component 120 based on actual requirements.

Figure 5:
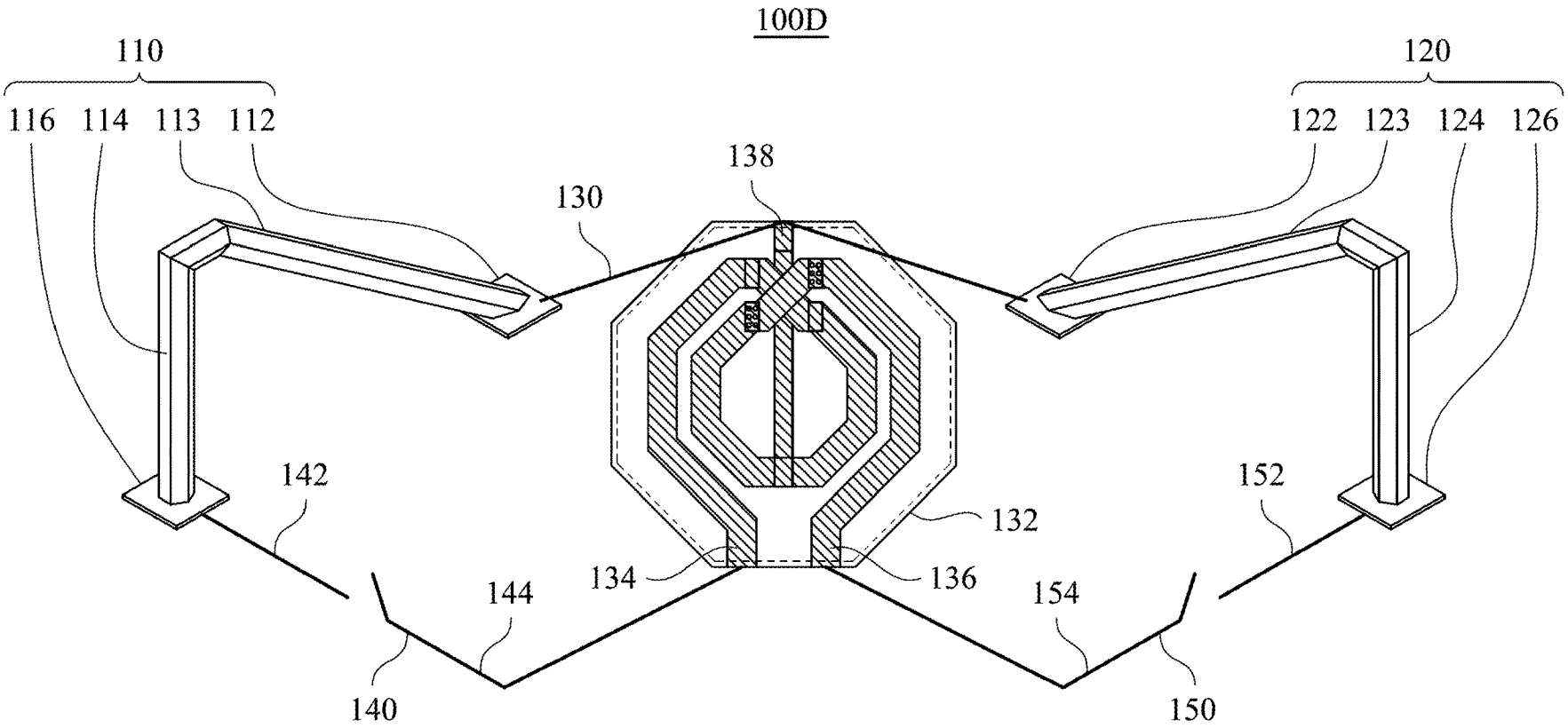
FIG. 5 is a schematic diagram of an inductor structure according to embodiments of the present disclosure.

FIG. 5 is a schematic diagram of an inductor structure according to embodiments of the present disclosure. Compared with the inductor structure 100B of FIG. 3, the disposition of the inductor structure 100D of FIG. 5 is different, which is described below. A first terminal 142 of the first switch 140 of the inductor structure 100D is coupled to one terminal 116 of the first curve metal component 110, and a second terminal 144 of the first switch 140 is coupled to the first terminal 134 of the spiral-shaped inductor 132. A first terminal 152 of the second switch 150 of the inductor structure 100D is coupled to one terminal 126 of the second curve metal component 120, and a second terminal 154 of the second switch 150 is coupled to the second terminal 136 of the spiral-shaped inductor 132. The connection component 130 is coupled to a center-tapped terminal 138 of the spiral-shaped inductor 132. Since the inductor structure 100D further comprises the switches 140, 150, the inductance of the inductor structure 100D can be adjusted by controlling the switches 140, 150, such that the application range of the inductor structure 100D can be extended. It is noted that the basic structures of the curved metal components 110, 120 of FIG. 5 are similar to those of the curved metal components 110, 120 of FIG. 1, such that a detailed description of the basic structures in FIG. 5 is omitted herein.

Figure 6:
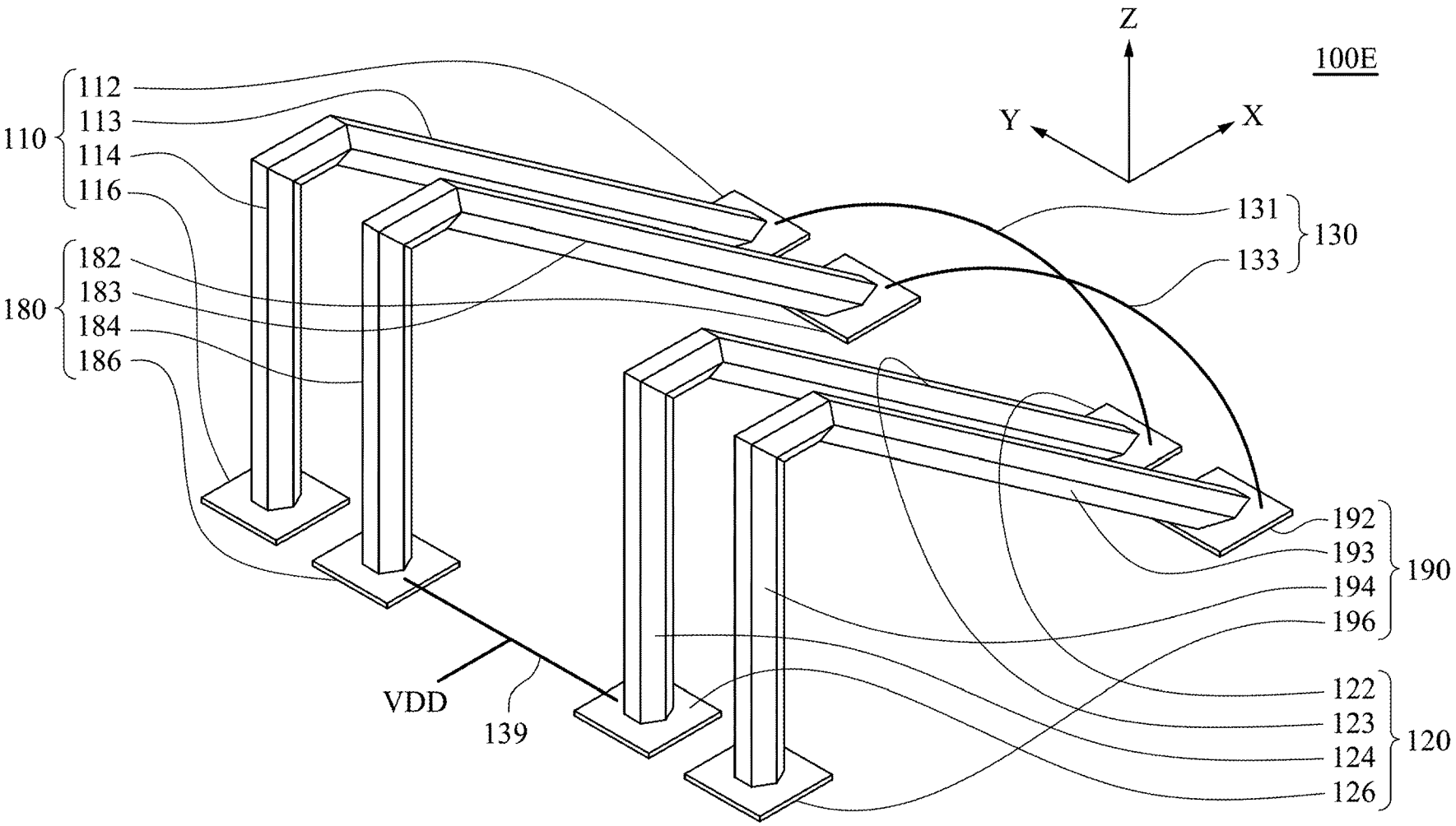
FIG. 6 is a schematic diagram of an inductor structure according to embodiments of the present disclosure.

FIG. 6 is a schematic diagram of an inductor structure according to embodiments of the present disclosure. Compared with the inductor structure 100 of FIG. 1, the inductor structure 100E further comprises a third curved metal component 180 and a fourth curved metal component 190. The structure in FIG. 6 is a normal flat inductor whose coil is curved from an XY surface to a YZ surface or an XZ surface. It is noted that the basic structures of the curved metal components 110, 120, 180, 190 of FIG. 6 are similar to those of the curved metal components 110, 120 of FIG. 1, such that a detailed description of the basic structures in FIG. 6 is omitted herein. The third curved metal component 180 is disposed on a layer (not shown in the figure). In addition, the third curved metal component 180 is located at a second plane (e.g., the XZ surface). The fourth curved metal component 190 is disposed on the layer. Moreover, the fourth curved metal component 190 is located at the second plane (e.g., the XZ surface). One terminal 192 of the fourth curved metal component 190 is coupled to one terminal 182 of the third curved metal component 180.

In one embodiment, the connection component 130 comprises a first connection unit 131 and a second connection unit 133. A first terminal of the first connection unit 131 is coupled to one terminal 112 of the first curve metal component 110, and a second terminal of the first connection unit 131 is coupled to one terminal 122 of the second curve metal component 120. A first terminal of the second connection unit 133 is coupled to one terminal 182 of the third curved metal component 180, and a second terminal of the second connection unit 133 is coupled to one terminal 192 of the fourth curved metal component 190. In another embodiment, the first curve metal component 110 is adjacent to the third curved metal component 180, and the second curve metal component 120 is adjacent to the fourth curved metal component 190. In still another embodiment, the first curve metal component 110, the third curved metal component 180, the second curve metal component 120 and the fourth curved metal component 190 are disposed sequentially. In yet another embodiment, another terminal 126 of the second curve metal component 120 is coupled to another terminal 186 of the third curved metal component 180 through a connection component 139, and the connection component 139 is configured to receive a power supply voltage VDD.

Figure 7:
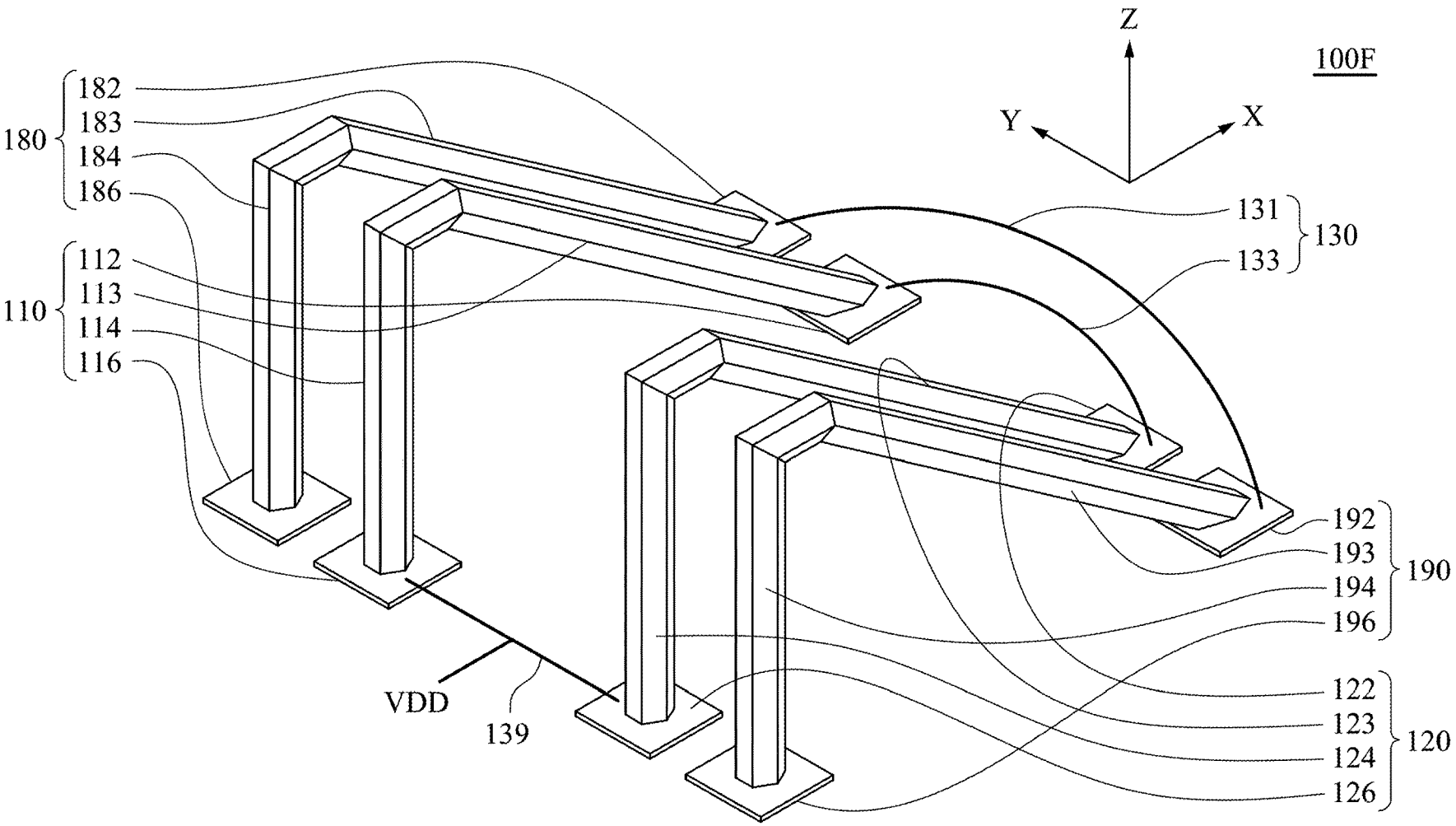
FIG. 7 is a schematic diagram of an inductor structure according to embodiments of the present disclosure.

FIG. 7 is a schematic diagram of an inductor structure according to embodiments of the present disclosure. Compared with the inductor structure 100 of FIG. 1, the inductor structure 100F further comprises a third curved metal component 180 and a fourth curved metal component 190. It is noted that the basic structures of the curved metal components 110, 120, 180, 190 of FIG. 7 are similar to those of the curved metal components 110, 120 of FIG. 1, such that a detailed description of the basic structures in FIG. 7 is omitted herein. The third curved metal component 180 is disposed on a layer (not shown in the figure). In addition, the third curved metal component 180 is located at a second plane (e.g., the XZ surface). The fourth curved metal component 190 is disposed on the layer. Moreover, the fourth curved metal component 190 is located at the second plane (e.g., the XZ surface). One terminal 192 of the fourth curved metal component 190 is coupled to one terminal 182 of the third curved metal component 180. Furthermore, the third curved metal component 180 and the fourth curved metal component 190 are disposed outwardly of the first curve metal component 110 and the second curve metal component 120.

In one embodiment, the first curve metal component 110 is adjacent to the third curved metal component 180, and the second curve metal component 120 is adjacent to the fourth curved metal component 190. In another embodiment, the third curved metal component 180, the first curve metal component 110, the second curve metal component 120 and the fourth curved metal component 190 are disposed sequentially. In yet another embodiment, one terminal 116 of the first curve metal component 110 is coupled to one terminal 126 of the second curve metal component 120 through the connection component 139, and the connection component 139 is configured to receive the power supply voltage VDD.

Figure 8:
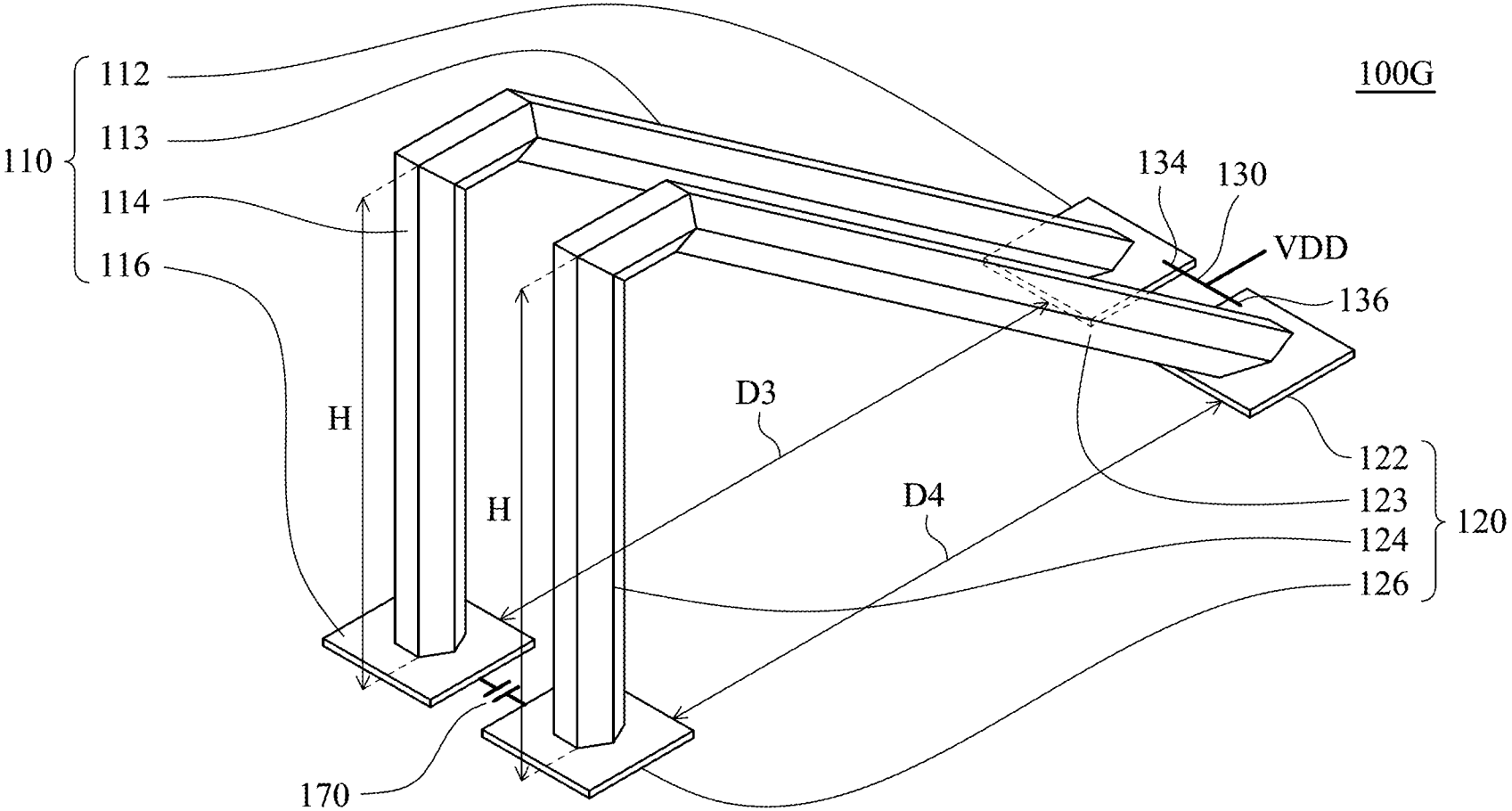
FIG. 8 is a schematic diagram of an inductor structure according to embodiments of the present disclosure.

FIG. 8 is a schematic diagram of an inductor structure according to embodiments of the present disclosure. Compared with the inductor structure 100 of FIG. 1, the inductor structure 100G in FIG. 8 further comprises a capacitor 170. The first terminal 134 of the connection component 130 is coupled to the first terminal 112 of the first curve metal component 110, and the second terminal 136 of the connection component 130 is coupled to the first terminal 122 of the second curve metal component 120. In addition, a first terminal of the capacitor 170 is coupled to the second terminal 116 of the first curve metal component 110, and a second terminal of the capacitor 170 is coupled to the second terminal 126 of the second curve metal component 120.

In one embodiment, the first curve metal component 110 comprises a first pad 112, a second pad 116 and a first strip portion (comprising structures marked 113 and 114). A first terminal of the first strip portion is coupled to the first pad 112, and a second terminal of the first strip portion is coupled to the second pad 116. The second curve metal component 120 comprises a third pad 122, a fourth pad 126 and a second strip portion (comprising structures marked 123 and 124). A first terminal of the second strip portion is coupled to the third pad 122, and a second terminal of the second strip portion is coupled to the fourth pad 126. In another embodiment, the connection component 130 is configured to receive the power supply voltage VDD.

In another embodiment, a distance D3 from the first pad 112 to the second pad 116 is about 200 um to 300 um, and a distance D4 from the third pad 122 to the fourth pad 126 is about 200 um to 300 um. Each of the first strip portion (comprising structures marked 113 and 114) and the second strip portion (comprising structures marked 123 and 124) has a height H. The height H is from the pad 116, 126 to the top of the first strip portion or the second strip portion. The height H is about 150 um to 250 um. Moreover, the diameter of each of the first strip portion and the second strip portion is about 15 um to 35 um.

Figure 9:
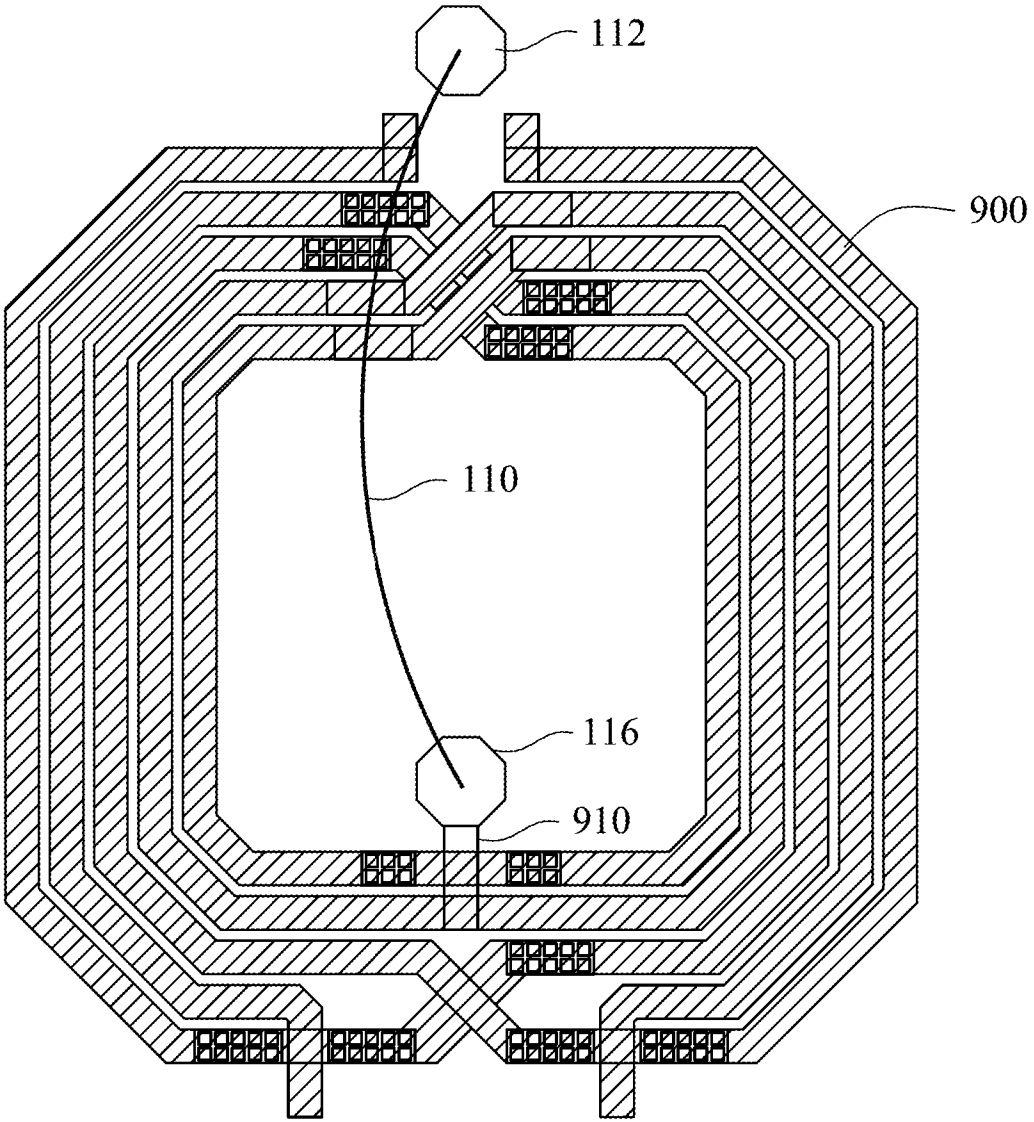
FIG. 9 is an application diagram of an inductor structure according to embodiments of the present disclosure.

FIG. 9 is an application diagram of an inductor structure according to embodiments of the present disclosure. As shown in the figure, with respect to the layout of the circuit, there is a need to connect a center tap 910 of the inductor 900 to an outer pad. The inductor structure of embodiments of the present disclosure can connect the center tap 910 to an outer pad, which is described below. Referring to FIG. 9, the inductor structure 100 comprises a curved metal component 110 and pads 112, 116. The pad 116 is coupled to the center tap 910. The curved metal component 110 can connect the center tap 910 to an outer pad (e.g., the pad 112) through the pad 116. Since the inductor structure 100 is a curve metal structure, and the curve metal structure is arched in a direction away from the center tap 910, it is distanced from the center tap 910. Hence, there is a smaller parasitic capacitance between these two elements, thereby enhancing the efficiency of the whole circuit. Moreover, since the curve metal structure of the inductor structure 100 has a better current bearing capacity, the application range of the whole circuit is increased. However, the present disclosure is not limited to the structure shown in FIG. 9. Except for the requirement that the pad 112 is located above the inductor 900, the pad 112 can be located at a right side, left side, bottom or another appropriate position of the inductor 900, depending on actual requirements.

Figure 10:
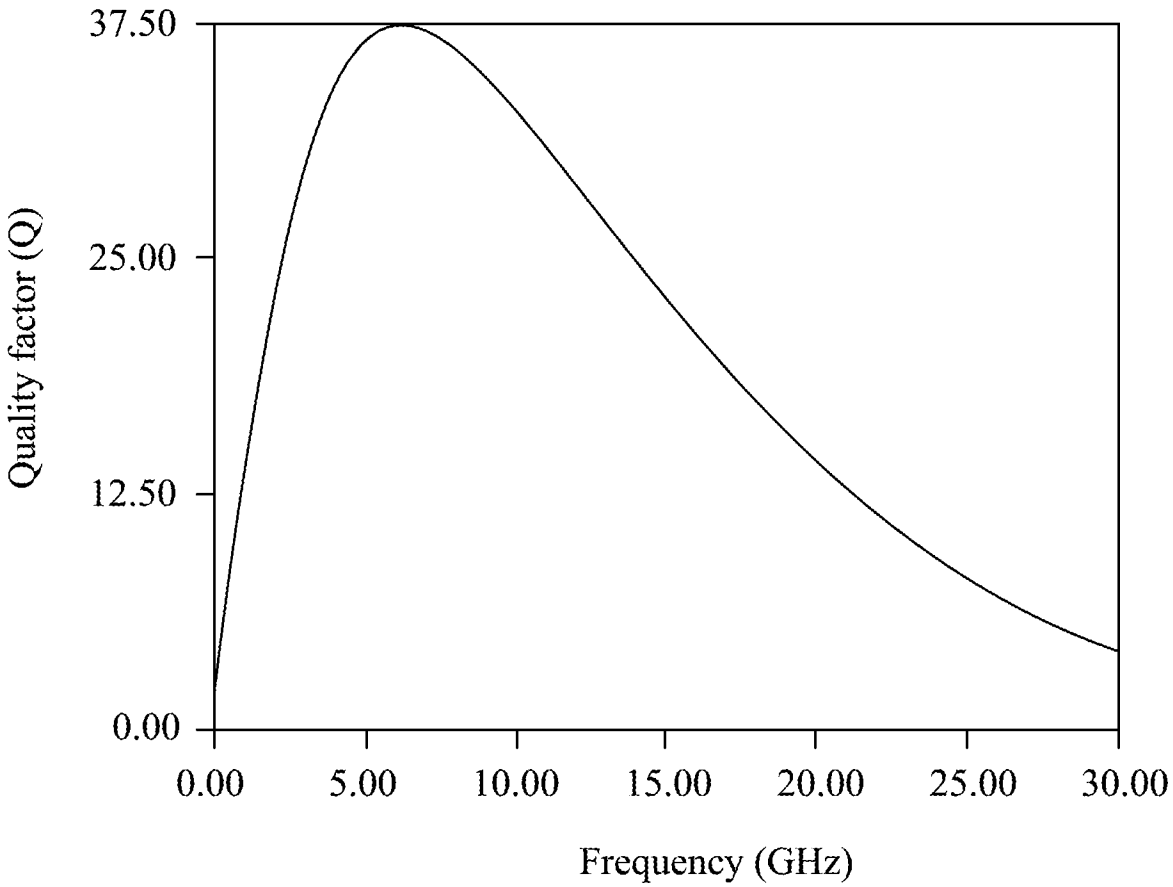
FIG. 10 is an experimental data diagram of an inductor structure according to embodiments of the present disclosure.

FIG. 10 is an experimental data diagram of an inductor structure according to embodiments of the present disclosure. This experimental data diagram is used for describing the quality factor Q of the inductor structure when the inductor operates in different frequencies. As shown in the figure, the quality factor Q of the inductor structure of the present disclosure is 37.5. Therefore, the diagram shows that the inductor structure of the present disclosure indeed can improve the quality factor and enhance the efficiency of the inductor structure.

In view of the above embodiments of the present disclosure, it is apparent that the application of the present disclosure has the advantages as follows. Embodiments of the present disclosure provide an inductor structure to improve the problems related to designs of spiral-shaped inductors or 8-shaped inductors being limited by the area of the chip, and relate also to the cost of spiral-shaped inductors and 8-shaped inductors being high. Furthermore, embodiments of the present disclosure provide an inductor structure to improve the problems related to the inductors being close to a substrate such that coupling easily occurs between the inductors and the substrate to thereby significantly affect the quality factor of the inductors.

Although the present disclosure has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims.

What is claimed is:

1. An inductor structure, comprising:

a first curve metal component, disposed on a layer, wherein the layer is located at a first plane, the first curve metal component is located at a second plane, and the first plane is perpendicular to the second plane, wherein a first terminal and a second terminal of the first curve metal component are at the first plane;

a second curve metal component, disposed on the layer, wherein the second curve metal component is located at the second plane, wherein the second curve metal component is directly adjacent to the first curve metal component, and the second curve metal component is parallel to the first curve metal component;

a third curved metal component disposed on the layer, wherein the third curved metal component is located at the second plane;

a fourth curved metal component disposed on the layer, wherein the fourth curved metal component is located at the second plane, and one terminal of the fourth curved metal component is coupled to one terminal of the third curved metal component; and a first connection component, coupled to the first curve metal component and the second curve metal component, wherein the first connection component is configured to receive a fixed voltage.

2. The inductor structure of claim 1, wherein each of the first curve metal component and the second curve metal component comprises a first strip portion and a second strip portion which are coupled to each other, wherein the first strip portions and the second strip portions are disposed at a first direction and a second direction respectively, and the first direction is different from the second direction, wherein the first strip portions are located at one side of the inductor structure, and the second strip portions are located at another side of the inductor structure.

3. The inductor structure of claim 2, wherein the first connection component is coupled to the first strip portion of the first curve metal component and the first strip portion of the second curve metal component.

4. The inductor structure of claim 1, wherein the first connection component comprises:

a first connection unit, wherein a first terminal of the first connection unit is coupled to one terminal of the first curve metal component, and a second terminal of the first connection unit is coupled to one terminal of the second curve metal component; and a second connection unit, wherein a first terminal of the second connection unit is coupled to one terminal of the third curved metal component, and a second terminal of the second connection unit is coupled to one terminal of the fourth curved metal component.

5. The inductor structure of claim 4, wherein the first curve metal component is adjacent to the third curved metal component, and the second curve metal component is adjacent to the fourth curved metal component.

6. The inductor structure of claim 1, wherein the third curved metal component and the fourth curved metal component are disposed outwardly of the first curve metal component and the second curve metal component.

7. The inductor structure of claim 6, wherein the first curve metal component is adjacent to the third curved metal component, and the second curve metal component is adjacent to the fourth curved metal component.

8. The inductor structure of claim 1, wherein the fixed voltage is a power supply voltage.

9. The inductor structure of claim 5, wherein the first curved metal component, the third curve metal component, the second curve metal component and the fourth curved metal component are disposed sequentially.

10. The inductor structure of claim 7, wherein the third curved metal component, the first curve metal component, the second curve metal component and the fourth curved metal component are disposed sequentially.

11. The inductor structure of claim 9, further comprises:

a second connection component, coupled to the third curve metal component and the second curve metal component, wherein the second connection component is configured to receive the fixed voltage.

12. The inductor structure of claim 10, further comprises:

a second connection component, coupled to the first curve metal component and the second curve metal component, wherein the second connection component is configured to receive the fixed voltage.

* * * * *